United States Patent [19]

Wardale

[11] 4,306,611

[45] Dec. 22, 1981

[54] ROTARY HEAT EXCHANGER

[75] Inventor: David J. S. Wardale, Merced, Calif.

[73] Assignee: Corning Glass Works, Corning, N.Y.

[21] Appl. No.: 182,141

[22] Filed: Aug. 28, 1980

[51] Int. Cl.[3] ..... F28D 19/00

[52] U.S. Cl. ..... 165/7; 165/8; 165/10

[58] Field of Search ..... 165/7, 10, 8

[56] References Cited

U.S. PATENT DOCUMENTS

| | | | |
|---|---|---|---|
| 3,155,152 | 11/1964 | Conde et al. | 165/9 X |
| 3,482,622 | 12/1969 | Bracken, Jr. | 165/10 X |
| 3,511,309 | 5/1970 | Clifford et al. | 165/10 X |
| 3,525,384 | 8/1970 | Horton | 165/10 X |
| 3,623,544 | 11/1971 | McLean | 165/8 |
| 3,771,592 | 11/1973 | Sayers | 165/10 |
| 3,885,942 | 5/1975 | Moore | 165/10 X |

*Primary Examiner*—Albert W. Davis
*Attorney, Agent, or Firm*—Richard N. Wardell

[57] ABSTRACT

Disclosed is a novel rotary heat exchanger and heat exchange system for use in gas turbine engines and other environments. The heat exchanger includes a ceramic disk having a ring gear extending about the outer circumference thereof. The ring gear is joined to the ceramic disk by means of an elastomeric member. However, means are provided for keeping the elastomeric member below its degradation temperature. These means include the provision of filler material for blocking a plurality of passages at a first and second face of the disk thus forming annular bands concentric therewith on opposite faces of the disk. A plurality of passages at the periphery of the disk radially outwardly of the bands are unobstructed by the filler material such that cooling air may flow therethrough so as to keep the elastomeric material at the desired temperature.

11 Claims, 3 Drawing Figures

ROTARY HEAT EXCHANGER

BACKGROUND OF THE INVENTION

The present invention relates in general to an improved rotary heat exchanger and in particular it relates to a novel heat exchange system for gas turbine engines.

Rotary heat exchangers or heat recovery wheels are utilized for the absorption of heat from exhaust gases travelling in one duct which heat is subsequently extracted from the wheel for preheating input gases, travelling in an adjacent duct. Rotary heat exchangers or heat recovery wheels are well known in gas turbine engines and in other applications.

Such heat recovery wheels are typically formed from glass-ceramic materials because of their low coefficient of thermal expansion, low thermal conductivity and their high resistance to oxidation and corrosion. In some applications it is desirable to drive such ceramic wheels from the periphery thereof by attaching a ring gear to the circumference of the wheel which mates with a pinion gear for rotating the wheel through the exhaust gas and input gas ducts. Because the aforementioned ring gear is typically made of metal which has a differing coefficient of thermal expansion from that of the ceramic, some provision must be made to accommodate the differences in the thermal expansion between the ceramic wheel body and the metal ring gear. One approach for providing such flexibility is disclosed in U.S. Pat. No. 3,623,544—McLean which discloses metal springs situated about the periphery of the ceramic heat exchanger and to which the aforementioned ring gear is attached. The metal springs are attached to the ceramic disk by means of solid glass-ceramic blocks cemented to the ceramic disk which surround and reinforce the springs. The McLean approach is expensive and a rather less expensive approach is disclosed in U.S. Pat. No. 3,525,384—Horton wherein, rather than by the provision of metal springs, the aforementioned ring gear is linked to the ceramic disk by means of an elastomeric material bonded to both components. Silicone elastomer materials have been used for this purpose, however, these tend to degrade rapidly above about 500° F. (260° C.). This degradation results in shrinking and hardening of the elastomeric material which may result in failure of either the bond of the elastomeric material to the ceramic disk or even failure of the ceramic material itself due to its inability to expand while constricted by the hardened elastomeric component. Since, in a typical 4 to 1 compression ratio gas turbine engine, the exhaust entering the rotary heat exchange often may reach temperatures of 1400° F. (760° C.), the aforementioned elastomeric material may rise to temperatures exceeding 500° F. (260° C.), which is above the degradation temperature of known elastomers.

It would be desirable to provide a rotary heat exchanger of the glass-ceramic type driven by a ring gear fastened to it by means of a flexible member which is of simpler construction and more inexpensive than the metal spring type members disclosed in the aforementioned McLean patent.

Moreover, it would be desirable to provide a rotary heat exchanger made from a glass-ceramic material and driven by a metal ring gear extending about the periphery thereof which is fastened to the heat recovery wheel by means of an elastomeric material and yet which does not suffer from the high temperature degradation mentioned above.

SUMMARY OF THE INVENTION

These and other objects of the present invention are achieved by the provision of a rotary heat exchanger comprising a ceramic disk having a first and a second face with a first set of passages extending therebetween. A ring gear extends about the circumference of the disk. The ring gear is joined to the disk by means of an elastomeric member situated therebetween. Filler material blocks a subset of the passages forming an annular band of blocked passages on each face near the periphery of the disk, the annular bands being concentric with the disk. However, a plurality of passages at the periphery of the disk are unobstructed by the filler material.

When utilized in a gas turbine engine, the periphery of the aforementioned rotary heat exchanger rotates through a high pressure-low temperature chamber containing gas (e.g. air) with a temperature below the degradation temperature of the elastomeric member. The unobstructed passageways at the periphery of the wheel are so constructed that low temperature gas situated in the high pressure-low temperature chamber is caused to flow through the unobstructed passages extracting heat from the periphery of the wheel and keeping the elastomeric member relatively cool.

In one embodiment, the unobstructed passageways are axially aligned with the axis of the rotary heat exchanger. In this embodiment, the heat exchanger has a larger outside diameter at one face than at the other face such that the disk is frusto-conical. In another embodiment, the passageways traversing the heat recovery wheel are inclined at an angle to the axis of the disk. In either embodiment, the total pressure (dynamic plus static) on one side of the unobstructed passageways at the periphery of the wheel differs from the total pressure (dynamic plus static) at the other side of said passageways causing a flow of cooling air therethrough.

BRIEF DESCRIPTION OF THE DRAWING

The present invention will be more fully understood by reference to the accompanying drawing in which.

DETAILED DESCRIPTION OF THE PREFERRED EMBODIMENT

Figure 1:
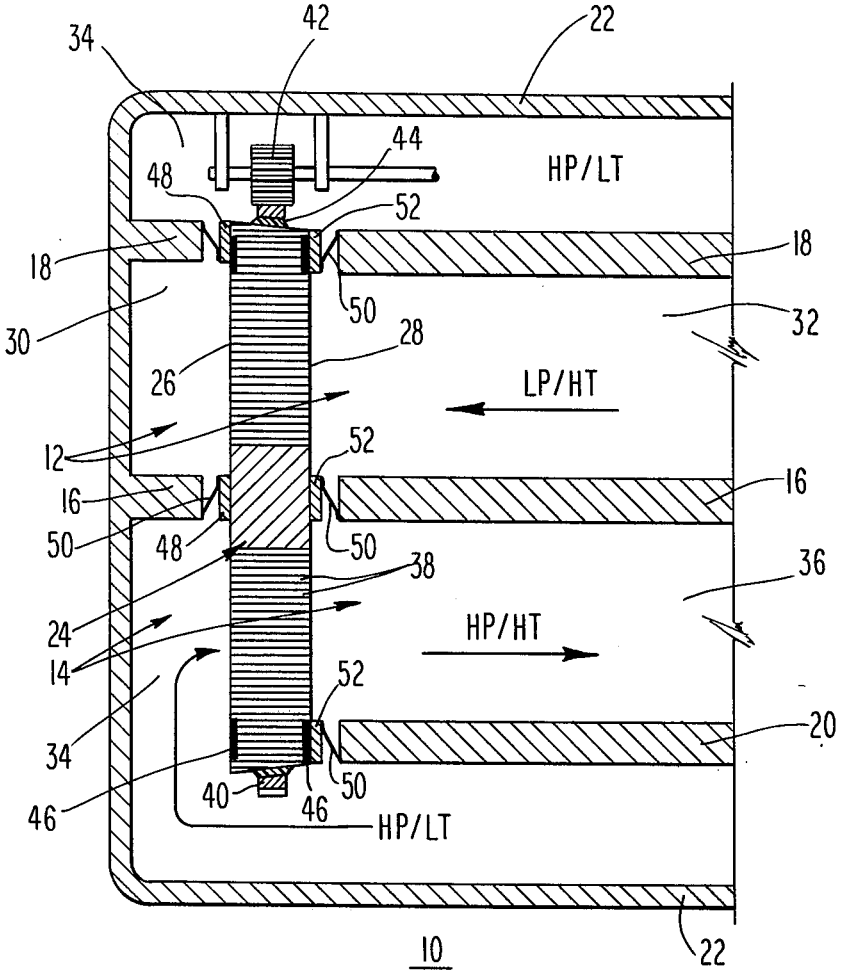
FIG. 1 is a sectional view of a portion of a gas turbine engine showing the relationship of a ceramic rotary heat exchanger and ring gear to the engine housing and to the inlet and exhaust ducts therein.

Referring now to FIG. 1, a portion of a gas turbine engine is shown generally at 10. The gas turbine engine 10 includes a low pressure exhaust duct 12 and a high pressure inlet duct 14. Inlet and exhaust gases flow in ducts 12 and 14 in the direction of arrows as shown. The low pressure exhaust duct 12 and the high pressure inlet duct 14 are separated by a common wall 16. The low pressure duct is defined by the space between the common wall 16 and an exterior wall 18. The high pressure inlet duct 14 is defined by the space between the common wall 16 and an exterior wall 20 and also by the space between exterior wall 20 and the engine housing 22. The space between exterior wall 18 and the engine housing 22 is also common to the high pressure inlet duct.

Rotating through the low pressure exhaust duct 12 and the high pressure inlet duct 14 is a rotary heat exchanger or heat recovery wheel shown generally at 24. In the preferred embodiment, the rotary heat exchanger 24 is a ceramic disk made usually in accordance with the teachings of U.S. Pat. Nos. 3,112,184 or 3,444,925, but it may also be made according to the teachings of U.S. Pat. No. 3,790,654 as segments which are later cemented together. The rotary heat exchanger 24 has a first face 26 and a second parallel face 28. The rotary heat exchanger 24 divides the low pressure exhaust duct 12 into a low pressure-low temperature chamber 30 at the first face and a low pressure-high temperature chamber 32 at the second face.

In a typical 4–1 compression ratio gas turbine engine, gas in the low pressure-high temperature chamber 32 is typically at a pressure of 16 p.s.i. (approx. 110 KPa) and at a temperature of 1400° F. (760° C.). Gas in the low pressure-low temperature chamber 30 is typically at a pressure of 15 p.s.i. (approx. 103 KPa) and at a temperature of 500° F. (260° C.).

The rotary heat exchanger 24 further divides the high pressure inlet duct 14 into a high pressure-low temperature chamber 34 at the first face 26 and a high pressure-high temperature chamber 36 at the second face 28. The circumference of the rotary heat exchanger 24 is also situated in the high pressure-low temperature chamber 34 which extends completely about the periphery of the disk 24. In a 4–1 compression ratio gas turbine engine, the gas in the high pressure-low temperature chamber is typically at a pressure of 60 p.s.i. (approx. 414 KPa) and a temperature of 450° F. (232° C.) while the temperature in the high pressure-high temperature chamber 36 is typically at a pressure of slightly less than 60 p.s.i. (approx. 414 KPa) and a temperature of slightly less than 1400° F. (760° C.).

As will be more fully explained below, the rotary heat exchanger 24 contains a first set of passages 38 extending from the first face 26 to the second face 28 thereof. The walls of the passages 36 extract heat from the gas (e.g. exhaust gas) in the low pressure exhaust duct 12, which heat is subsequently extracted from the walls of the passages for preheating inlet gases in the high pressure inlet duct 14. Catalytically active substances, such as noble metals can be situated on the walls of the passages 38 to enhance complete combustion of the exhaust gases and extraction of additional heat generated thereby. Situated about the circumference of the rotary heat exchanger 24 is drive means comprising a ring gear 40 which mates with a suitable power driven pinion gear 42. The ring gear 40 is joined to the outer circumference of the rotary heat exchanger 24 by means of an elastomeric member 44. One preferred elastomer to be utilized is Dow. Corning Sylgard 187.

Filler material 46 is utilized for blocking a subset of the passages 38. Carborundum Company's QF180 cement is the preferred filler material 46. The blocked passages form first and second annular bands concentric with the axis of the heat exchanger 24 about the first and second faces 26 and 28 thereof, respectively. However, in accordance with an important aspect of the present invention, a plurality of passages at the periphery of the disk 24 radially outwardly of the annular bands formed by the passages obstructed by the filler material 46 are left unobstructed by such filler material.

Abutting the first face 26 of the heat exchanger 24 in the general vicinity of the first annular band, is a first sealing means 48 biased against the heat exchanger 24 from the exterior wall 18 and from the common wall 16 by means of springs 50. The first sealing means 48 separates the high pressure-low temperature chamber 34 from the low pressure-low temperature chamber 30. As will be more fully explained below, the first sealing means 48 partially blocks some of the unobstructed passages radially outwardly of the first annular band of passages obstructed by filler material 46 at the first face 26. A second sealing means 52 abuts against the second face 28 of the rotary heat exchanger 24 in the vicinity of the second annular band. The second sealing means 52 is biased against the second face 28 of the disk 24 from the exterior walls 18 and 20 as well as from the common wall 16 also by means of springs 50. The second sealing means 52 separates the low pressure-high temperature chamber 32 from the high pressure-high temperature chamber 36 and from the high pressure-low temperature chamber 34. It also separates the high pressure-low temperature chamber 36 from the high pressure-low temperature chamber 34. The annular bands formed by filler material 46 provide a more suitable surface on which sealing means 48, 52 slide to effect a rubbing seal.

Figure 2:
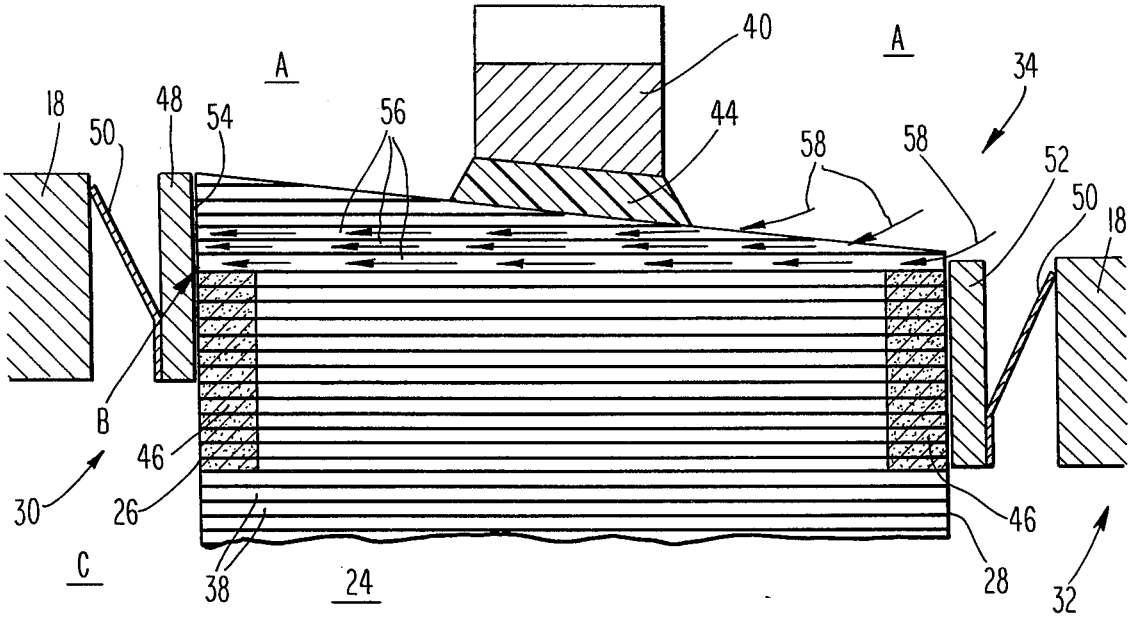
FIG. 2 is an exploded cross-sectional view of the periphery of a ceramic rotary heat exchanger in accordance with one embodiment of the present invention.

Referring now to FIG. 2, the radially outwardmost portion of a rotary heat exchanger 24 manufactured in accordance with a first embodiment of the present invention will be described. In the embodiment shown in FIG. 2, the passages 38 extending from the first face 26 of the disk 24 to the second face 28 of the disk are parallel to the axis thereof. However, the outer diameter of the first face 26 of the disk 24 is greater than the outer diameter of the second face 28 of the disk 24 such that the disk is frusto-conical. As shown in the FIG. 2, filler material 46 blocks a subset of the passages extending from the first to the second face. Although not shown in FIG. 2, the filler material forms annular bands concentric with the disk 24 and extending about the first and second face 26 and 28, respectively. Situated at the circumference of the disk 24 is the aforementioned ring gear 40 which is fastened to the ceramic disk 24 by means of an elastomeric member 44. In accordance with an important aspect of the present invention, unobstructed passages 38 radially outwardly of the passages blocked by filler material 46 are unobstructed by that filler material. Because the disk 24 in this embodiment is frusto-conical and because the passages 38 are axially aligned with the axis of the disk 24, at least some of the passages (shown at 56) which are unobstructed by the filler material 46 open to the circumference of the disk 24 at one end thereof while others may open to the second face 28.

Also, as shown in FIG. 2, the aforementioned first sealing means 48 is biased against the first face 26 of the disk 24. Due to manufacturing tolerances and operating pressures, a small gap 54 is found between the first sealing means 48 and the first face 26 of the disk 24. It will be seen that those passages 56 radially outwardly of passages obstructed by filler material 46 are partially blocked by the first sealing means 48. From the description of the gas turbine engine set forth above, it will be appreciated that the pressure at both points labled A in FIG. 2 is relatively high with respect to the pressure at point C shown therein. As set forth above, in a typical 4–1 compression ratio gas turbine engine, the pressure at both points labled A is approximately 60 p.s.i. (414 KPa) while that at point C is approximately 15 p.s.i. (103 KPa). The pressure at point B shown in FIG. 2, since it is intermediate points A and C along the gap 54, is at some value between the pressure at points A and the pressure at point C. Accordingly, the pressure at the end of the passages 56 nearest to face 28 will be the same as the pressure at point A while the pressure at the other end of those same passages is that found at point B. Since the pressure at point B is lower than that at point A, gas in the high pressure-low temperature chamber 34 tends to flow in the direction of the arrows 58 from that chamber into the low pressure-low temperature chamber 30. In so doing, heat is extracted from the vicinity of the elastomeric member 44 thereby keeping it below its degradation temperature of the elastomer.

Figure 3:
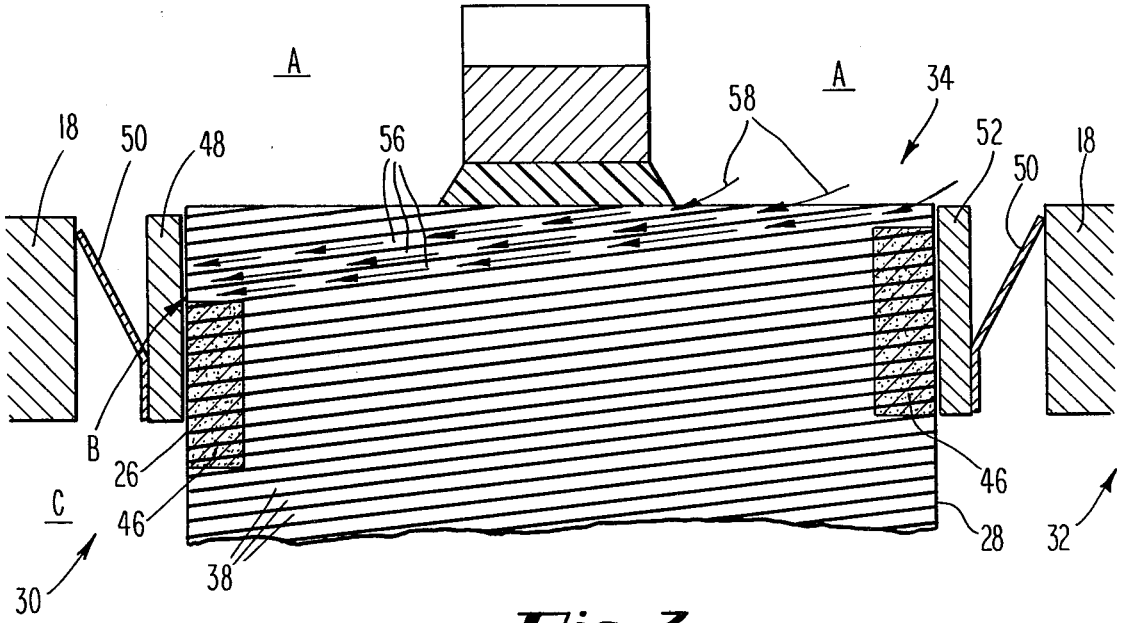
FIG. 3 is an exploded cross-sectional view of the periphery of a rotary heat exchanger in accordance with the second embodiment of the present invention.

Referring now to FIG. 3, a second embodiment of the present invention will be described wherein the passageways 38 are inclined at an angle (e.g. 5 or 6 degrees) with respect to the axis of the disk 24. In FIG. 3, like numerals are utilized to describe like features to those shown in the the embodiment of FIG. 2. It will be appreciated that the provision of passages inclined at an angle to the axis of the disk 24 permits the opening of unobstructed passages 56 at the periphery of the disk 24 around the circumference thereof even though the disk is a cylindrical rather than a frusto-conical body. Like the embodiment shown in FIG. 2, since the pressure at point B at one end of the unobstructed passages 56 is less than that at point A at the other end of said passages, relatively low temperature gas flows in the direction of arrows 58 to extract heat from the vicinity of the elastomeric member 44 thereby keeping that member below its degradation temperature.

However, in this latter embodiment, disk 24 may be more easily manufactured in slightly frusto-conical form (with face 28 of larger diameter than the diameter of face 26) and with its passages inclined as shown in FIG. 2 by firing the disk 24 while it rests on its face 28. Thus, a gradation of radial/circumferential firing shrinkage occurs in a axial direction through disk 24 by the fact that frictional forces on face 28 reduce the radial/circumferential firing shrinkage at that face as compared with face 26 and planes with disk 24 parallel to those two faces.

While particular embodiments of the present invention have been shown and described, it will be appreciated that other modifications of the invention, not specifically mentioned, will occur to those skilled in the art and are intended to be included within the scope of the appended claims.

What is claimed is:

1. A rotary heat exchanger comprising:

a ceramic disk having a first set of passages extending from a first face to a second face;

a drive means extending about the outer circumference of said disk;

an elastomeric member situated between said drive means and said outer circumference for joining said drive means to said disk;

filler material for blocking a subset of said first set of passages at both said first and said second faces, said blocked passages forming a first annular band about said first face and a second annular band about said second face, said annular bands being substantially concentric with said disk, a plurality of passages at the periphery of said disk radially outwardly of said bands being unobstructed by said filler material.

2. The rotary heat exchanger of claim 1 wherein:

at least some of said plurality of unobstructed passages extend from said first face to said circumference.

3. The rotary heat exchanger of claim 2 wherein said plurality of unobstructed passages are axially aligned with said disk.

4. The rotary heat exchanger of claim 3 wherein said first face has a larger outside diameter than does said second face such that said disk is frusto-conical.

5. The rotary heat exchanger of claim 2 wherein said plurality of unobstructed passages are inclined at an angle to the axis of said disk.

6. The rotary heat exchanger of claim 5 wherein said angle is 6 degrees.

7. The rotary heat exchanger of claim 5 wherein said angle is 5 degrees.

8. A heat exchanger system comprising:

a high pressure duct;

a low pressure duct; and a rotary heat exchanger rotating through said ducts, said heat exchanger dividing said low pressure duct into a low pressure-low temperature chamber at a first face of said heat exchanger and a low pressure-high temperature chamber at a second face of said heat exchanger and dividing said high pressure duct into a high pressure-low temperature chamber at said first face of said heat exchanger and a high pressure-high temperature chamber at said second face of said heat exchanger, said high pressure-low temperature chamber also extending about the periphery of said heat exchanger, said heat exchanger being a ceramic disk having a first set of passages extending from a first face to a second face and having a drive means extending about the outer circumference of said disk;

an elastomeric member between said drive means and said outer circumference of said disk, said elastomeric member and said drive means also being situated in said high pressure-low temperature chamber; and filler material for blocking a subset of said first set of passages at both said first and said second faces, said blocked passages forming a first annular band about said first face and a second annular band about said second face, said annular bands being substantially concentric with said disk with a plurality of passages at the periphery of said disk radially outwardly of said bands being unobstructed by said filler material.

9. The heat exchange system of claim 8 wherein at least some of said plurality of passages extend from said first face to said circumference.

10. The heat exchange system of claim 9 further comprising:

first sealing means abutting said first face for separating said high pressure-low temperature chamber from said low pressure-low temperature chamber, said sealing means partially blocking said plurality of unobstructed passages at said first face.

11. The heat exchanger system of claim 10 further comprising:

second sealing means abutting said second face for separating said low pressure-high temperature chamber from said high pressure-high temperature and from said high pressure-low temperature chambers.

* * * * *